US009698550B2

(12) United States Patent
Byrne et al.

(10) Patent No.: US 9,698,550 B2
(45) Date of Patent: Jul. 4, 2017

(54) ELECTRICAL POWER OUTLET HOUSING ASSEMBLY

(71) Applicants: Norman R. Byrne, Ada, MI (US); Robert L. Knapp, Rockford, MI (US); Steven K. Meek, Grand Rapids, MI (US); Matthew R. Andree, Rockford, MI (US)

(72) Inventors: Norman R. Byrne, Ada, MI (US); Robert L. Knapp, Rockford, MI (US); Steven K. Meek, Grand Rapids, MI (US); Matthew R. Andree, Rockford, MI (US)

( * ) Notice: Subject to any disclaimer, the term of this patent is extended or adjusted under 35 U.S.C. 154(b) by 0 days.

(21) Appl. No.: 15/090,895

(22) Filed: Apr. 5, 2016

(65) Prior Publication Data

US 2016/0294137 A1 Oct. 6, 2016

Related U.S. Application Data

(60) Provisional application No. 62/143,422, filed on Apr. 6, 2015.

(51) Int. Cl.

| | |
|---|---|
| ***H01R 31/02*** | (2006.01) |
| ***H01R 25/00*** | (2006.01) |
| *H01R 103/00* | (2006.01) |
| *H01R 13/422* | (2006.01) |
| *H01R 13/506* | (2006.01) |
| *H01R 24/78* | (2011.01) |

(52) U.S. Cl.

CPC ..... *H01R 31/02* (2013.01); *H01R 25/006* (2013.01); *H01R 13/422* (2013.01); *H01R 13/506* (2013.01); *H01R 24/78* (2013.01); *H01R 2103/00* (2013.01)

(58) Field of Classification Search

CPC .... H01R 31/02; H01R 25/006; H01R 13/506; H01R 13/588; H01R 13/422; H01R 24/78

USPC .... 439/540.1, 652, 653, 654, 655, 954, 701, 439/712, 715, 724, 535

See application file for complete search history.

(56) References Cited

U.S. PATENT DOCUMENTS

| | | | | |
|---|---|---|---|---|
| 4,303,296 | A * | 12/1981 | Spaulding ..... | H01R 13/516 361/796 |
| 5,087,207 | A | 2/1992 | Byrne | |
| 5,096,431 | A | 3/1992 | Byrne | |
| 5,676,566 | A * | 10/1997 | Carlson, Jr. ..... | G02B 6/3897 439/491 |

(Continued)

*Primary Examiner* — Harshad Patel

(74) *Attorney, Agent, or Firm* — Gardner, Linn, Burkhart & Flory, LLP

(57) ABSTRACT

An electrical power outlet housing assembly is provided for mounting electrical and/or data outlets in a work area or the like. The housing assembly includes at least one outlet housing portion having an interior surface that is configured to support the electrical components of an electrical and/or data outlet. The outlet housing portion cooperates with a housing enclosure portion by filling an opening of the housing enclosure, where the housing enclosure and outlet housing portions cooperate with a housing base to define an interior cavity that receives the electrical or electronic components associated with the electrical or data outlets. The electrical components may be installed without any separate mechanical fasteners, and the housing components may be assembled with minimal use of separate fasteners.

20 Claims, 9 Drawing Sheets

(56) References Cited

U.S. PATENT DOCUMENTS

| | | | | |
|---|---|---|---|---|
| 5,738,548 | A * | 4/1998 | Rutulante | H01R 13/72 439/4 |
| D405,416 | S * | 2/1999 | Byrne | D13/139.4 |
| 5,906,517 | A | 5/1999 | Crane et al. | |
| 6,042,426 | A * | 3/2000 | Byrne | H01R 25/00 439/131 |
| 6,350,151 | B1 * | 2/2002 | Elliot | H01R 9/2416 439/535 |
| 6,896,547 | B2 * | 5/2005 | Caveney | G02B 6/3897 439/100 |
| 7,410,379 | B1 | 8/2008 | Byrne | |
| 7,465,178 | B2 | 12/2008 | Byrne | |
| 8,221,131 | B1 * | 7/2012 | Mazyck | H01R 25/003 439/13 |
| 8,500,492 | B2 | 8/2013 | Brown et al. | |
| 8,736,106 | B2 | 5/2014 | Byrne et al. | |
| 8,894,436 | B2 | 11/2014 | Su | |
| 9,000,298 | B2 | 4/2015 | Byrne et al. | |
| 9,048,598 | B2 | 6/2015 | Byrne et al. | |
| 9,166,308 | B2 | 10/2015 | Byrne | |
| 9,312,673 | B2 | 4/2016 | Byrne et al. | |
| 9,368,924 | B2 | 6/2016 | Byrne et al. | |
| 9,543,692 | B2 | 1/2017 | Shomali | |
| 2004/0110415 | A1 * | 6/2004 | Huang | G06F 1/266 439/535 |
| 2009/0156061 | A1 * | 6/2009 | Bernstein | H01R 13/652 439/652 |
| 2016/0301169 | A1 | 10/2016 | Byrne et al. | |

* cited by examiner

ELECTRICAL POWER OUTLET HOUSING ASSEMBLY

CROSS REFERENCE TO RELATED APPLICATION

The present application claims the benefit of U.S. provisional application Ser. No. 62/143,422, filed Apr. 6, 2015, which is hereby incorporated herein by reference in its entirety.

FIELD OF THE INVENTION

The present invention relates to electrical power outlets and, more particularly, to electrical power units for providing access to electrical power in work areas and the like.

BACKGROUND OF THE INVENTION

It is generally desirable to provide electrical power outlets in various types of work areas. In some cases electrical systems are configured to be modular, whereby electrical conductors are routed and connected together in different ways to provide desired configurations. Further, modular electrical systems are typically reconfigurable and adaptable as the use of a particular work area changes. Therefore, it is desirable to generally increase the flexibility of modular electrical systems, including providing different types of electrical outlets at different locations throughout a work area, for convenient access by users.

SUMMARY OF THE INVENTION

The present invention provides an electrical power outlet housing assembly that is particularly suitable for use with modular electrical power systems, including modular electrical power systems in which electrical conduits are routed along floors, wall exteriors, table surfaces, or the like. The power outlet housing is assembled in part using an outlet housing portion that is configured to support electrical contacts along an inner surface thereof. The electrical contacts can be engaged by respective prongs of male connectors that can be inserted through openings formed through the first housing portion in the vicinity of the electrical conductors. The outlet housing portion is supported at a housing enclosure portion that cooperates with the outlet housing portion to define an interior cavity that contains the electrical and/or electronic components and conductors, including those attached to the interior surface of the outlet housing portion. The outlet and housing enclosure portions further cooperate with a housing base that can establish a mechanical and electrical connection with a mounting surface, such as a raceway junction having its own electrical connectors. The electrical power outlet housing is assembled with only a few separate mechanical fasteners such as threaded screws, and the electrical conductors associated with the outlet housing portion may be coupled to the interior surface of the outlet housing portion without any separate mechanical fasteners. Optionally, a no-fastener assembly does not use separate screw fasteners or the like, and instead employs various interlocking components, including resilient latch tabs and tab-receiving portions. It is also possible to substitute one type of outlet housing portion for another, in order to adapt the housing assembly for different types of electrical and/or data outlets while changing only one of the housing portions that is used to construct the electrical power outlet housing.

According to one form of the present invention, a housing assembly is provided for mounting electrical and/or data outlets in a work area. The housing assembly includes an outlet housing portion, a housing enclosure portion, and a housing base. The outlet housing portion has an exterior surface and an interior surface, with the interior surface configured to support the electrical conductors of at least one electrical and/or data outlet. One or more openings formed in the outlet housing portion provide access to the electrical and/or data outlet, such as by receiving a plug or connector.

The outlet housing portion includes attachment structure along the interior surface, adjacent the one or more openings, with the attachment structure configured to releasably secure the electrical and/or data outlets, or for supporting individual conductors associated therewith. The housing enclosure portion is configured to engage the first housing portion, and the outlet and housing enclosure portions cooperate to define an interior cavity for receiving the electrical and/or data outlets or conductors that cooperate with housing surfaces to form such outlets. The exterior surface of the outlet housing portion and the exterior surface of the housing enclosure portion both form outer surfaces of the finished housing assembly, with the housing enclosure portion defining an opening in which the exterior surface of the outlet housing portion is mounted and made accessible. The housing base is coupled to the outlet and housing enclosure portions, and is configured to establish a mechanical connection to a mounting surface, typically having an electrical receptacle or connector associate therewith, for supplying electrical power and/or electronic signals or data to the outlet or outlets associated with the housing assembly.

According to another form of the present invention, a housing assembly is provided for mounting electrical and/or data outlets in a work area. The housing assembly includes an outlet housing portion, a housing enclosure portion, and a housing base. The outlet housing portion has an exterior surface and an interior surface, and defining at least one receptacle opening for receiving a connector associated with a data or power consumer. The housing enclosure portion is configured to engage and cooperate with the outlet housing portion to define an interior cavity for receiving at least one electrical contact or data outlet. The housing enclosure portion also defines an opening in which the outlet housing portion is mounted. The outlet housing portion includes attachment structure along the interior surface, adjacent the at least one receptacle opening and projecting into the interior cavity. The attachment structure is configured to support the at least one electrical contact or data outlet. The housing base is coupled to at least one of the outlet housing portion and the housing enclosure portion, and is configured for attachment to a mounting surface.

In one aspect, a lower region of the outlet housing portion, a lower region of the housing enclosure portion, and a lower region of the housing base all cooperate to form a lower region of the housing assembly.

Optionally, the lower region of the housing enclosure portion forms an outboard portion of the lower region of the housing assembly, the lower region of the housing base forms an inboard portion of the lower region of the housing assembly, and the lower region of the outlet housing portion is positioned between the lower regions of the housing enclosure and the housing base to thereby form an intermediate portion of the lower region of the housing assembly.

In another aspect, the outlet housing portion is generally L-shaped when viewed in profile, including an upright leg defining the at least one receptacle opening and the attachment structure, and a bottom leg extending outwardly from the upright leg.

Optionally, the housing enclosure portion is generally L-shaped at the opening when viewed in profile, and includes a bottom region framing an outboard portion of the bottom leg of the outlet housing portion, and an upright region framing the upright leg of the outlet housing portion.

In yet another aspect, the assembly further includes another outlet housing portion, and the housing enclosure portion defines two of the openings for receiving respective ones of the outlet housing portions. Optionally, the openings are positioned on opposite sides of the housing enclosure portion, and the exterior surfaces of the outlet housing portions are arranged to face outwardly in substantially opposite directions from one another.

In still another aspect, the housing base includes a generally U-shaped frame piece having a base wall located at a lower region of the housing assembly, and a pair of upstanding walls extending into the interior cavity. The outlet housing portions are mounted along and between respective opposite sides of the U-shaped frame piece, between the upstanding walls.

In a still further aspect, the assembly includes an electrical terminal mount having an attachment structure configured for releasable engagement with the attachment structure of the outlet housing portion. The electrical terminal mount cooperates with the interior surface of the outlet housing portion to secure the electrical contact or data outlet. Optionally, the attachment structure of the electrical terminal mount includes at least two latch tabs, and the attachment structure of the outlet housing portion includes at least two catches corresponding to the at least two latch tabs of the electrical terminal mount.

In another aspect, the housing assembly is in combination with the at least one electrical contact or data outlet, such as a 110-volt AC power outlet, a 220-volt AC power outlet, or a low voltage DC power outlet.

Thus, the electrical power outlet housing assembly of the present invention is readily assembled and disassembled or reconfigured with minimal use of separate fasteners, and is particularly well suited for use in work areas having modular electrical and/or data systems. The housing assembly can be quickly secured to a mounting surface in a manner that simultaneously establishes electrical connections to a power and/or data supply. For example the housing assembly may be incorporated into a low profile electrical raceway system for routing power or data in different directions throughout a work area or the like.

These and other objects, advantages, purposes and features of the present invention will become apparent upon review of the following specification in conjunction with the drawings.

DESCRIPTION OF THE PREFERRED EMBODIMENTS

Figure 1:
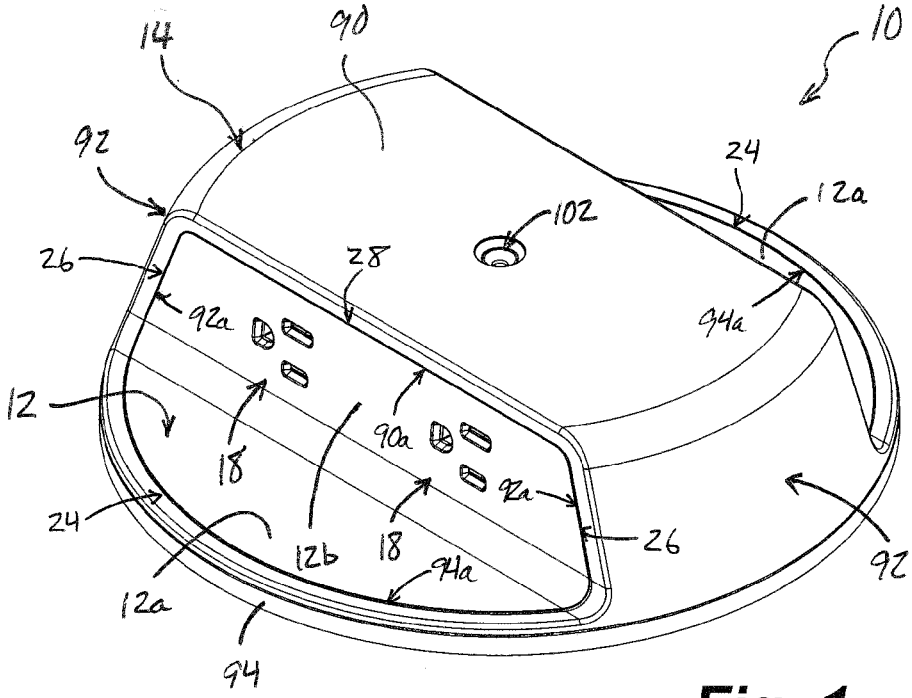
FIG. 1 is a top perspective view of an electrical power outlet housing assembly in accordance with the present invention.
Figure 2:
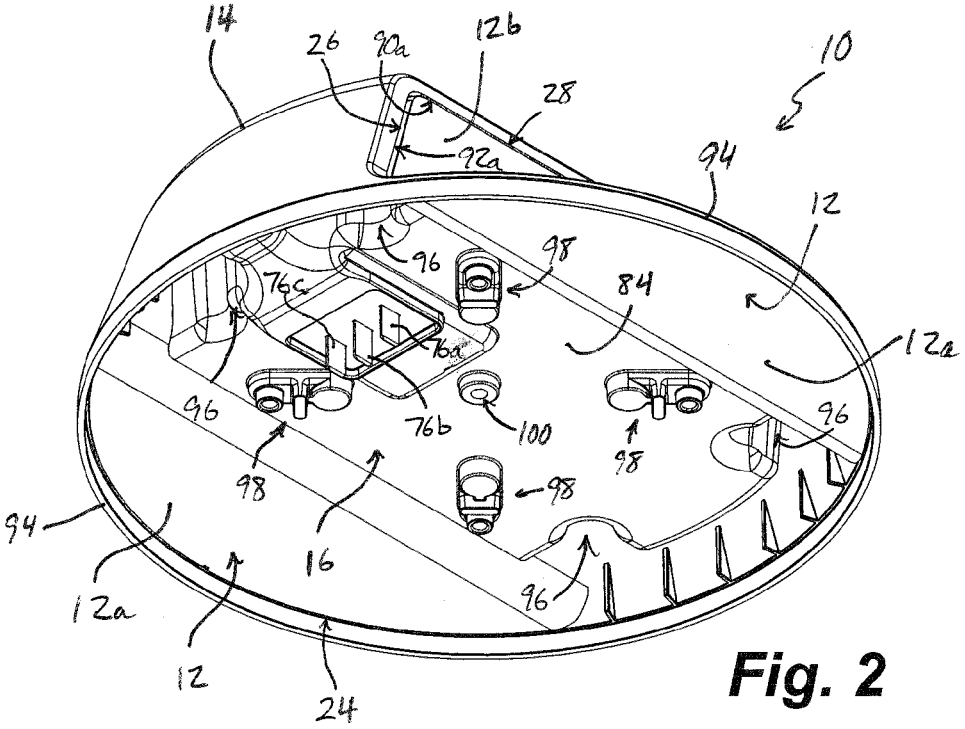
FIG. 2 is a bottom perspective view of the electrical power outlet housing assembly of FIG. 1.

Referring now to the drawings and the illustrative embodiments depicted therein, an electrical power outlet housing assembly 10 is assembled from four main housing components, including two outlet housing portions 12, a housing enclosure portion 14, and a housing base 16 (FIGS. 1 and 2). Assembly 10 may be configured for use with modular electrical power systems, and may be reconfigured to provide different types of electrical power and/or data outlets and connectivity, such as by installing different outlet housing portions and associated wiring and contacts. As will be described in more detail below, outlet housing portions 12, enclosure portion 14, and housing base 16 assembled together and provide access to electrical power at a plurality of electrical outlet openings 18 formed in outlet housing portions 12. Outlet housing portions 12 cooperate with respective electrical contact fixtures 20 that support electrical contact bars 22*a-c* in alignment with outlet openings 18 to supply power to electrical consumers plugged into the outlet openings 18. Thus, electrical contact bars 22*a-c* are assembled to electrical contact fixture 20, and then are further attached along an inner surface of one of outlet housing portions 12, without the use of separate fasteners, to form electrical outlets at the electrical power outlet housing 10.

Figure 3:
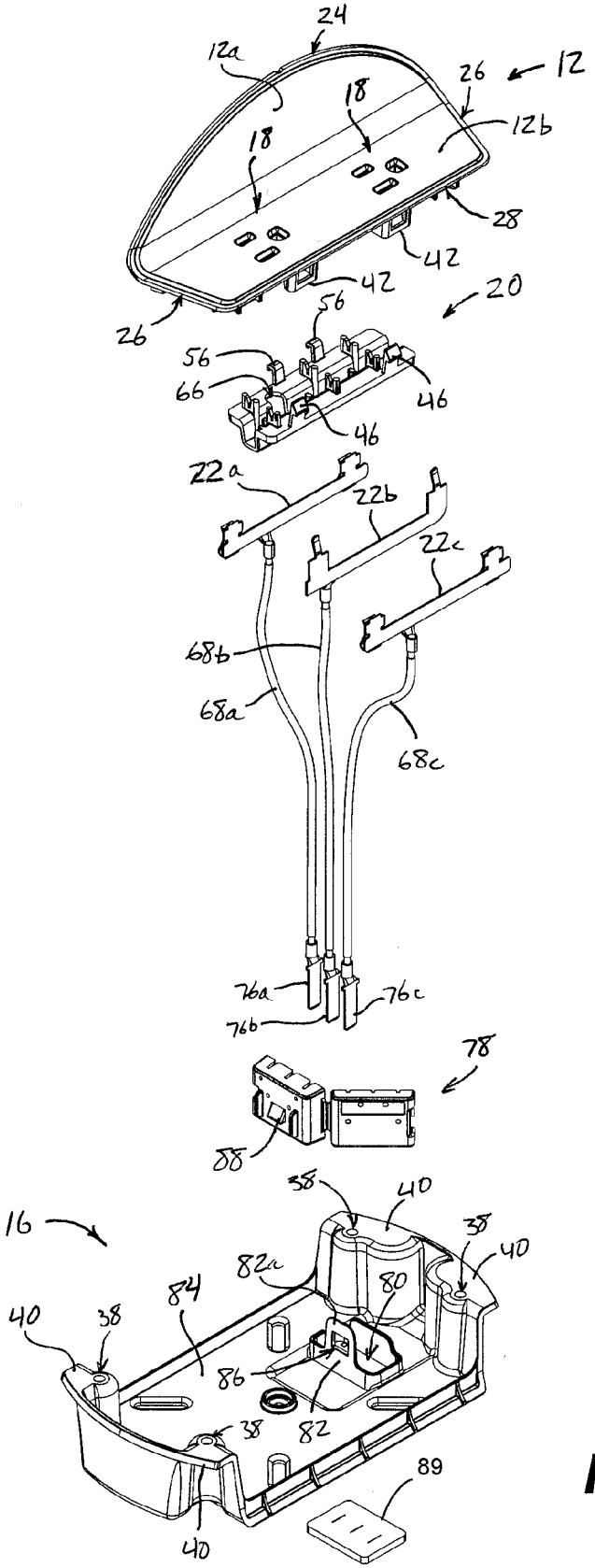
FIG. 3 is an exploded top perspective view of an outlet housing portion, housing base, and electrical terminal assembly of the electrical power outlet housing of FIG. 1.
Figure 4:
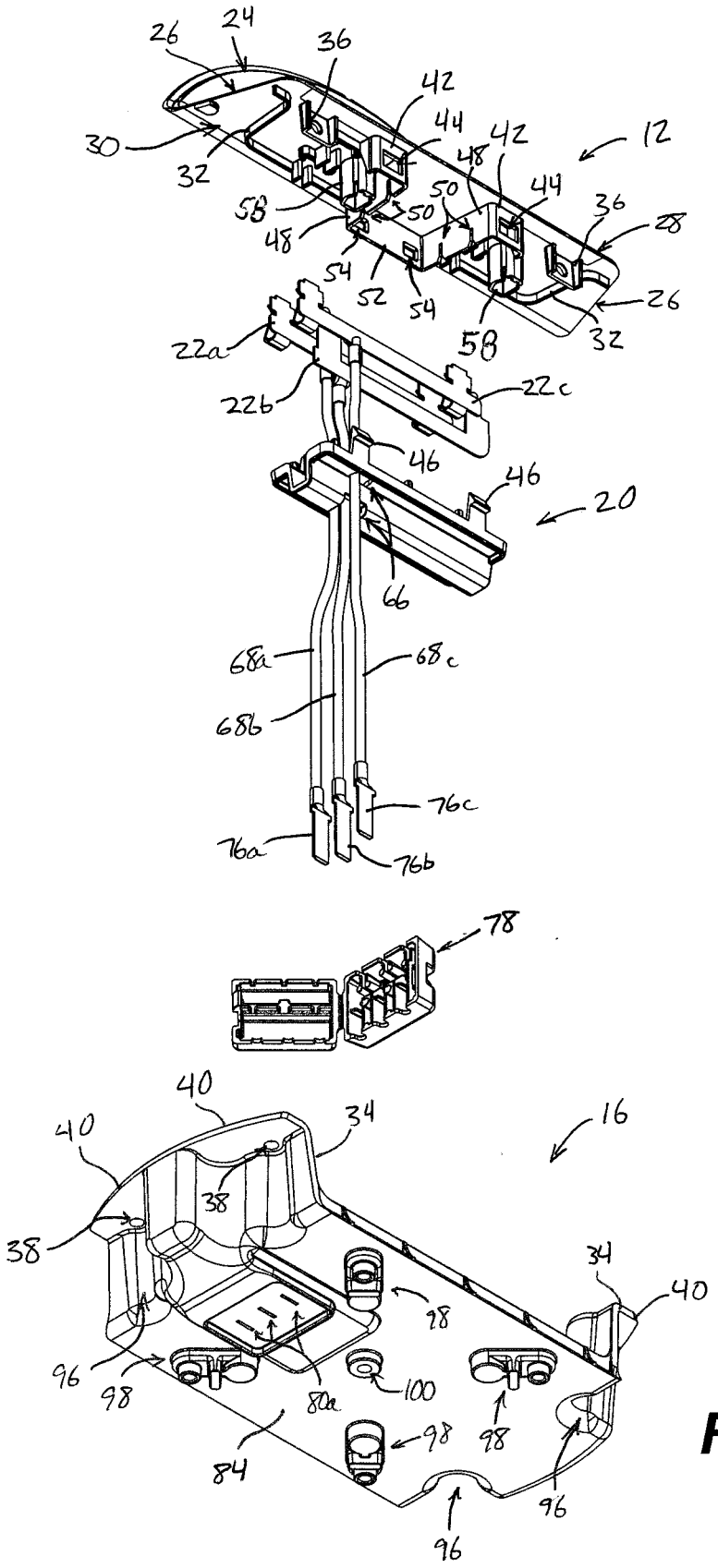
FIG. 4 is an exploded bottom perspective view of the outlet housing portion, housing base, and electrical terminal assembly of FIG. 3, with the housing base rotated 180 degrees about its vertical axis as compared to FIG. 3.
Figure 5:
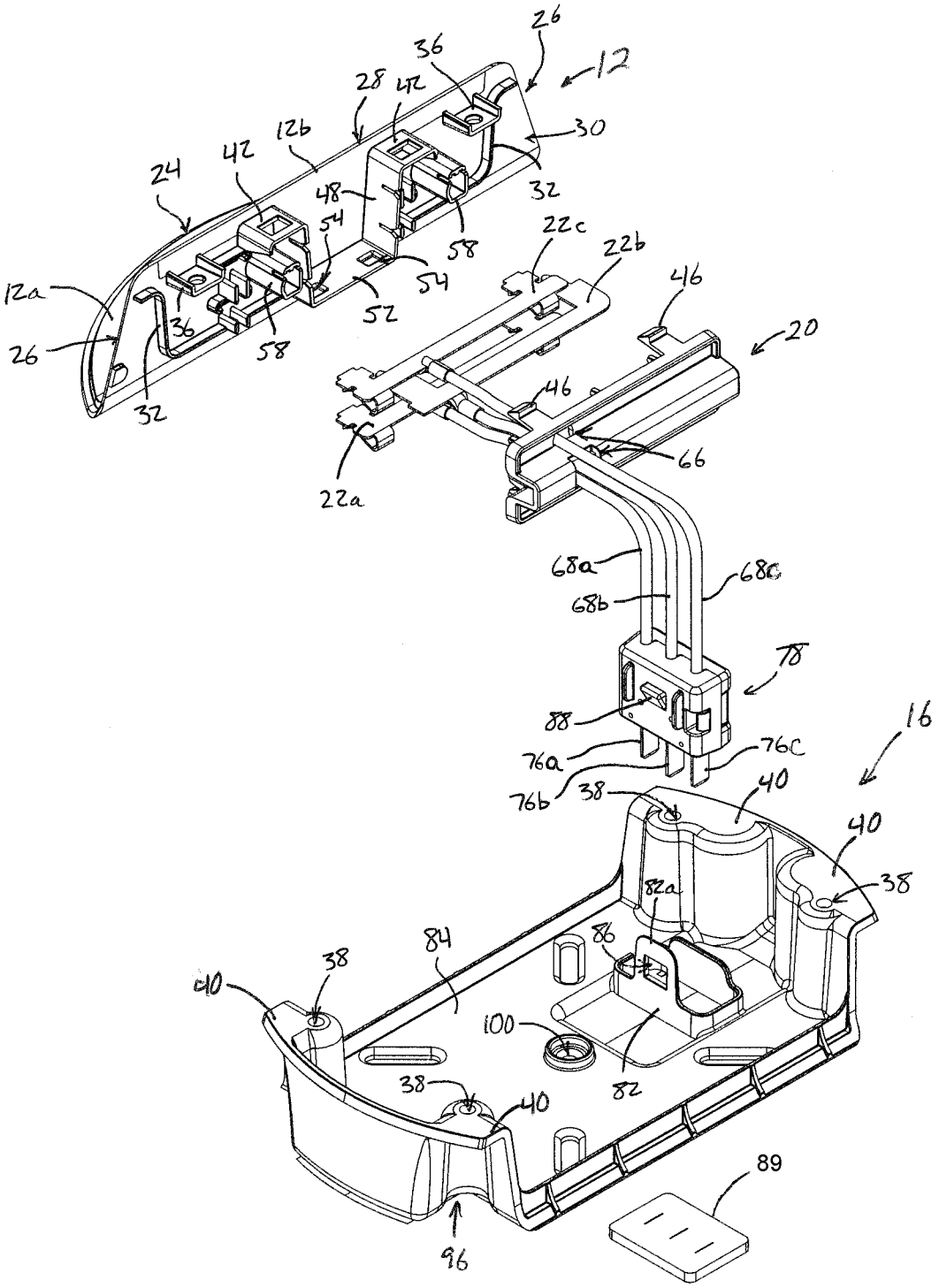
FIG. 5 is another exploded top perspective view of an outlet housing portion, housing base, and electrical terminal assembly of the electrical power outlet housing of FIG. 1, with the outlet housing portion rotated 90 degrees to show structure along its interior surface.
Figure 5A:
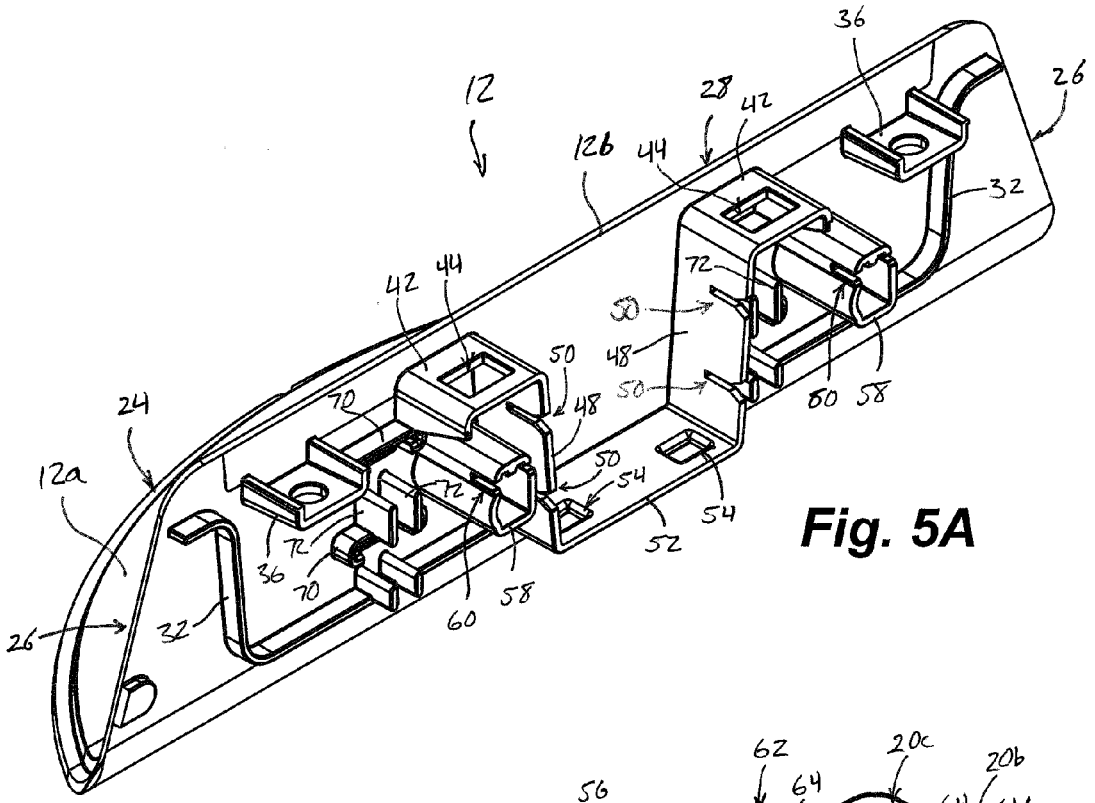
FIG. 5A is a perspective view of the interior surface of the outlet housing portion's upright leg.
Figure 9:
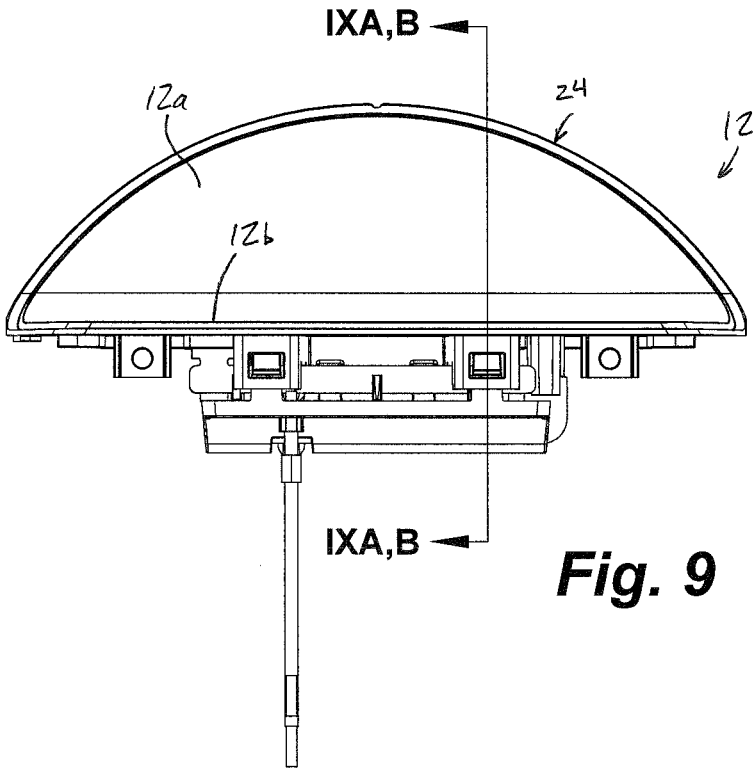
FIG. 9 is a top plan view of the outlet housing, contact fixture, and electrical contacts of FIG. 7.
Figure 9A:
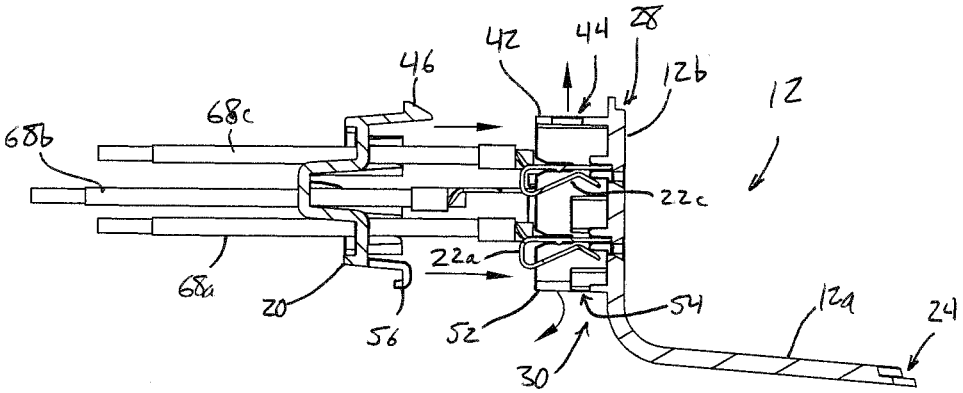
FIG. 9A is an end sectional elevation taken along line IXA,B-IXA,B, of FIG. 9, showing the contact fixture and electrical contacts just prior to engagement with the interior surfaces of the outlet housing portion.
Figure 9B:
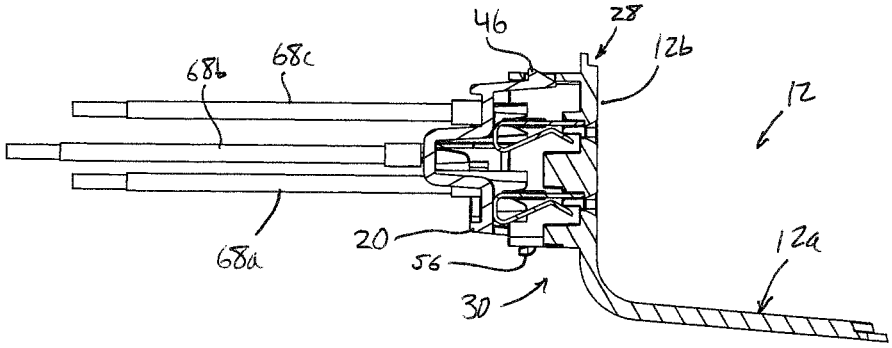
FIG. 9B is another end sectional elevation taken along section line IXA,B-IXA,B of FIG. 9, shown with the contact fixture and electrical contacts fully engaged with the interior surfaces of the outlet housing portion.

Outlet housing portions 12 are generally L-shaped (FIGS. 9A and 9B), each including a base leg 12*a* and an upright leg 12*b*, where outlet openings 18 are formed in upright leg 12*b*, such as shown in FIGS. 1 and 3. As viewed from above, base legs 12*a* have arcuate perimeter edges 24 that transition to upright perimeter edges 26 in the region of upright leg 12*b*, which has a substantially straight horizontal top edge 28. Referring to 4-5A, 6A, 7A and 9-9B, an interior surface or side 30 of upright leg 12*b* includes various inwardly-projecting walls that cooperate with housing base 16 and/or with electrical contact fixture 20 and electrical contact bars 22*a-c*. At outboard sides or ends of interior surface 30 are a pair of generally S-shaped walls 32 that are sized and shaped to engage respective wall edges 34 of housing base 16 (FIGS. 4-5A). Located just inboard of respective upper ends of the S-shaped walls 32 are a pair of fastener-receiving tabs 36 that extend inwardly and substantially align with respective openings 38 formed in upper horizontal walls 40 of housing base 16. Located further inboard of fastener-receiving tabs 36 are a pair of latch-receiving walls 42 having respective openings 44 configured to be engaged by respective resilient latch tabs 46 of electrical contact fixture 20. Extending downwardly from latch-receiving walls 42 are a pair of upright contact-receiving walls 48, each having a pair of slots 50 for receiving and supporting line/hot electrical contact bar 22*a* and neutral contact bar 22*c*.

Contact receiving walls 48 are joined together at a lower end of interior side 30 by a horizontal bottom wall 52 that has a pair of openings 54 configured to receive respective hooks 56 of electrical contact fixture 20, which hooks 56 are located generally across from resilient latch tabs 46 and spaced inboard of latch tabs 46 for engagement with openings 54, which are spaced inboard from openings 44. As best shown in FIGS. 4-5A, latch receiving walls 42, upright contact-receiving walls 48, and horizontal bottom wall 52 cooperate to form a generally U-shaped structure that projects inwardly along interior surface 30 of the upright leg 12*b* of outlet housing portion 12, in order to engage and support electrical contact fixture 20 with electrical contact bars 22*a-c*. Also defined along interior surface 30 are a pair of generally tubular ground passageways 58, each having a pair of slots 60 formed in the distal ends thereof, the slots 60 configured to receive respective portions of ground contact bar 22*b* (FIG. 6A) for establishing contact with a male ground prong of an electrical plug.

Figure 6:
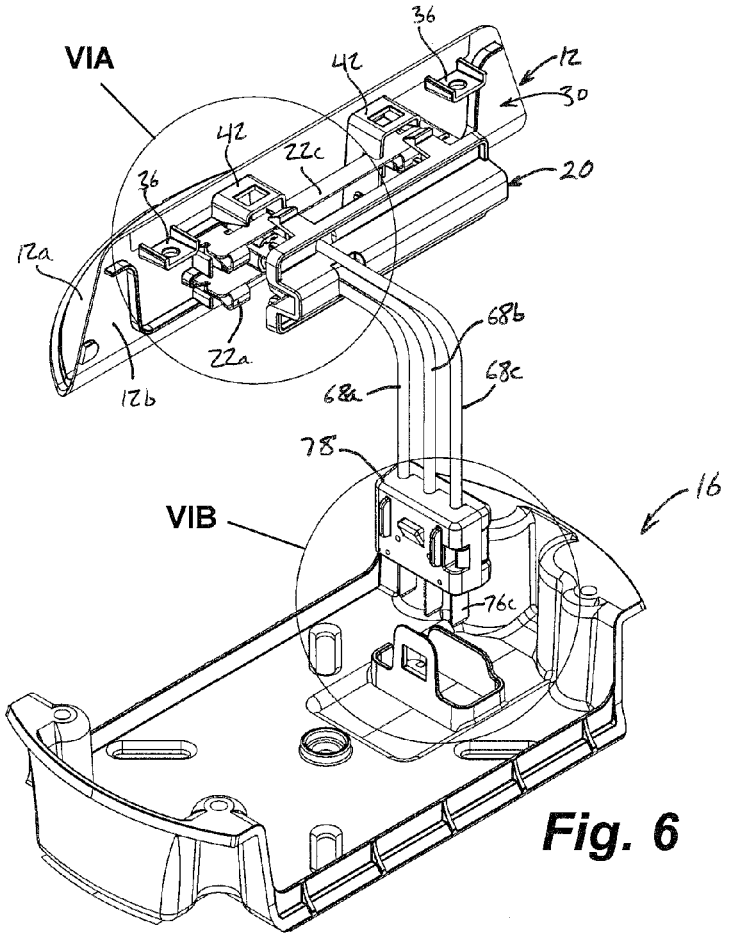
FIG. 6 is a partially exploded top perspective view of the outlet housing, housing base, and electrical connector assembly of FIG. 5, shown just prior to engagement of the electrical receptacle conductors and male plug with respective receiving portions of the outlet housing and housing base.
Figure 6A:
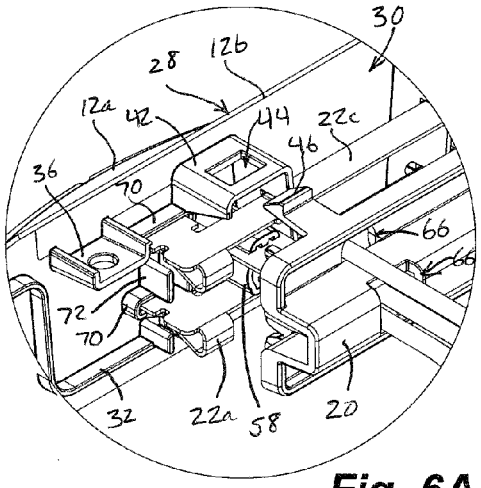
FIG. 6A is an enlarged view of the area designated VIA in FIG. 6.
Figure 6B:
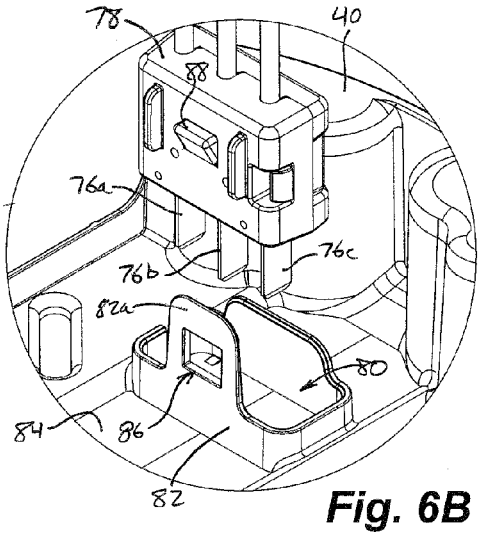
FIG. 6B is an enlarged view of the area designated VIB in FIG. 6.
Figure 7:
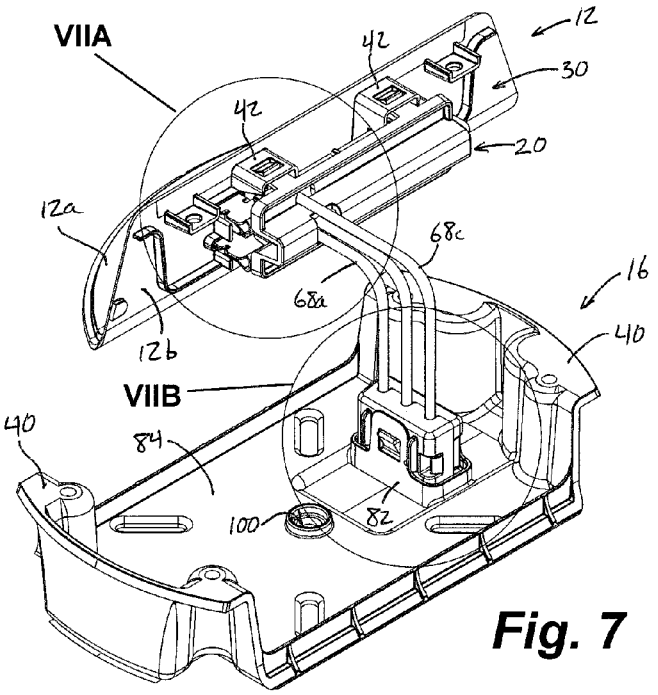
FIG. 7 is a partially exploded top perspective view of the outlet housing, housing base, and electrical connector assembly of FIG. 5, shown with the electrical receptacle conductors and electrical contact fixture attached to the outlet housing, and the male plug engaging a socket in the housing base.
Figure 7A:
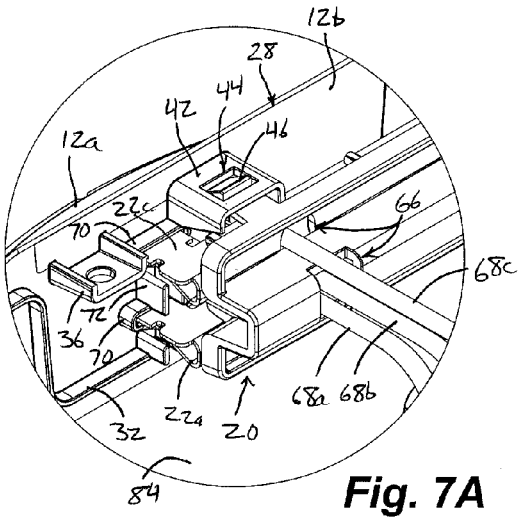
FIG. 7A is an enlarged view of the area designated VIIA of FIG. 7.
Figure 7B:
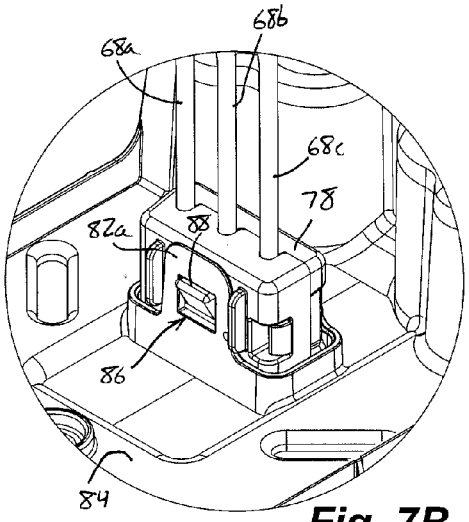
FIG. 7B is an enlarged view of the area designated VIIB of FIG. 7.

Additional structure is provided along interior side or surface 30 of the upright leg 12*b* of outlet housing portion 12, including generally C-shaped walls 70 surrounding line and neutral openings of outlet openings 18 (FIGS. 5A, 6A and 7A), where the C-shaped walls 70 receive respective portions of the line contact bar 22*a* or neutral contact bar 22*c* (FIGS. 6A and 7A). A pair of spaced apart vertical walls 72 are located between each pair of C-shaped walls 70, and help to maintain spacing of line contact bar 22*a* from neutral contact bar 22*c*, such as shown in FIGS. 6A and 7A.

Figure 5B:
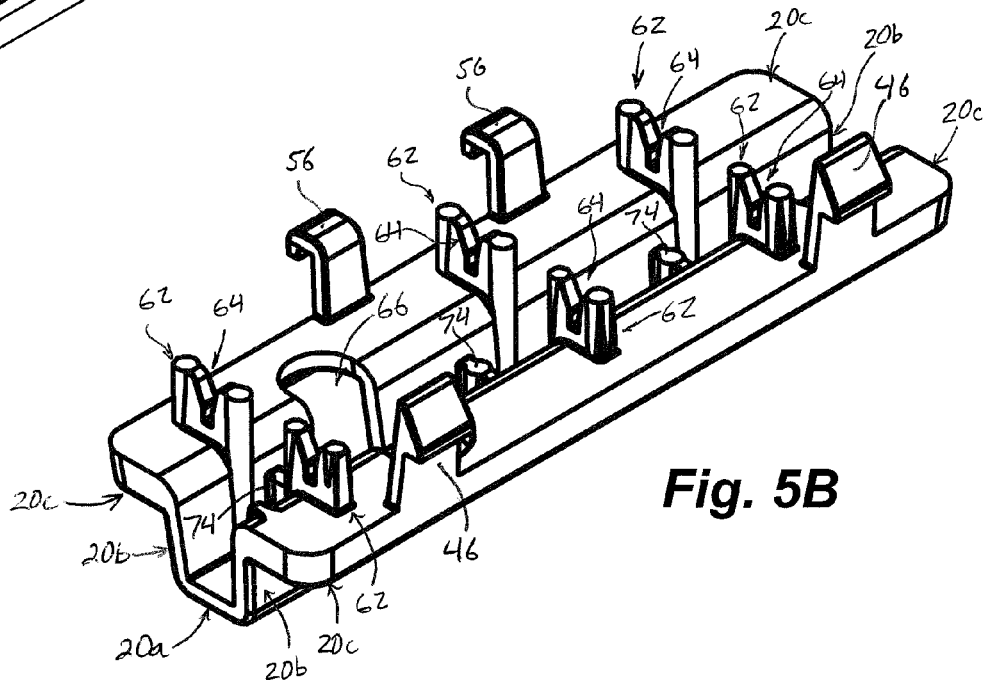
FIG. 5B is a perspective view of an electrical contact fixture configured for attachment to the interior surface of the outlet housing portions.

As best shown in FIGS. 4, 5, and 5B, electrical contact fixture 20 is generally U-shaped, including a base or bight portion 20*a*, a pair of upstanding legs 20*b*, and a pair of upper flanges 20*c* opposite bight portion 20*a*, With reference to FIG. 5B, resilient latch tabs 46 project upwardly or outwardly from one upper flange 20*c*, while hooks 56 project upwardly and outwardly from the opposite upper flange 20*c*, Electrical contact fixture 20 also defines openings 66 for receiving electrical conductors 68*a-c* that are coupled to respective ones of electrical contact bars 22*a-c* (FIG. 5). Upstanding walls 62 also project upwardly from the respective upper flanges 20*c*, but are located inboard of latch tabs 46 and hooks 56. In addition to resilient latch tabs 46 and hooks 56, electrical contact fixture 20 includes two longitudinally-aligned sets of three upstanding walls 62, each having a generally V-shaped notch 64 for receiving and supporting a respective one of line contact bar 22*a* and neutral contact bar 22*c*, In addition there is a set of three upstanding walls 74 projecting upwardly from bight portion 20*a*, which receive and support ground electrical contact bar 22*b* in substantially the same manner that upstanding walls 62 support respective ones of the line contact bar 22*a* and neutral contact bar 22*c*, Although only upper portions of the upstanding walls 74 are visible in FIG. 5B, it will be understood that the configuration of the upstanding walls 74 is substantially the same as that of the other upstanding walls 62.

Figure 8:
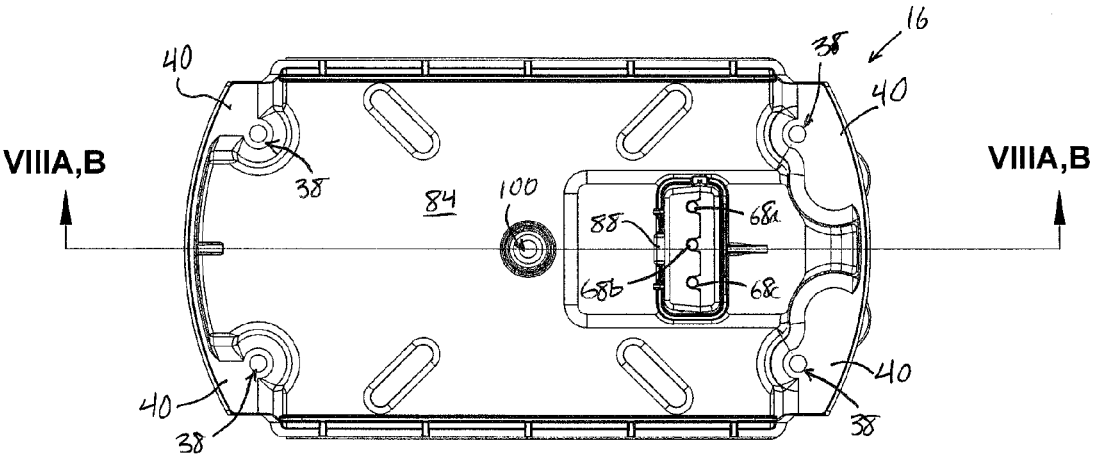
FIG. 8 is a top plan view of the housing base with male plug of FIG. 7.
Figure 8A:
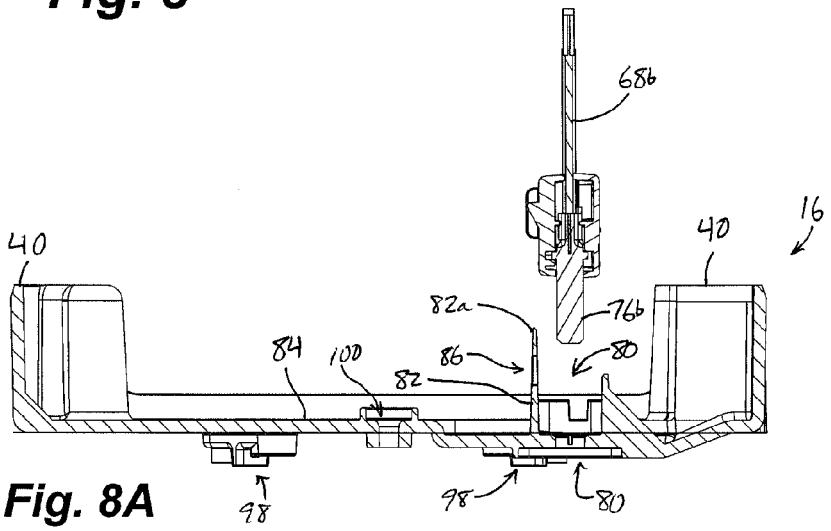
FIG. 8A is a side sectional elevation taken along section line VIIIA,B-VIIIA,B in FIG. 8, shown prior to insertion of the plug in the plug-receiving area of the housing base.
Figure 8B:
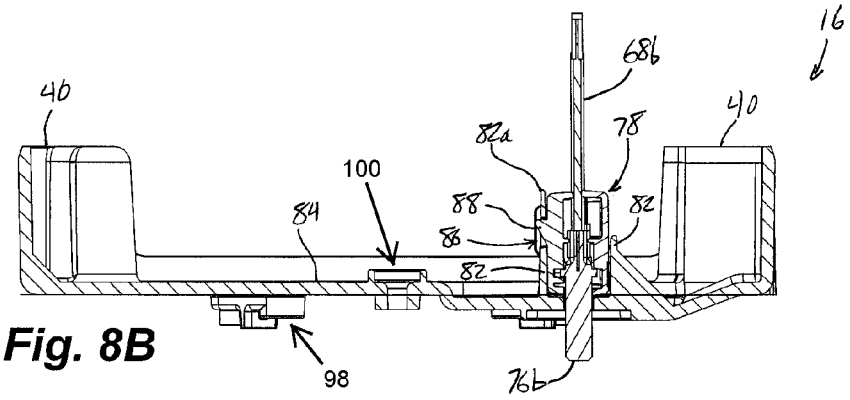
FIG. 8B is another side sectional elevation taken along section line VIIA,B-VIIIA,B in FIG. 8.

Electrical conductors 68*a-c* terminate at respective male blade terminals 76*a-c*, which in turn are received or mounted in a clamshell housing that forms a male plug connector 78 (FIGS. 3-5). Male connector 78 latches into a socket region 80 at the housing base's bottom wall 84, which is surrounded by a generally rectangular upstanding wall 82 such as shown in FIGS. 3-8B. Male blade terminals 76*a-c* extend downwardly through slot openings 80*a* formed in bottom wall 84 at socket region 80, such as shown in FIGS. 2 and 8B. Optionally, a soft gasket 89 (FIGS. 3 and 5) may be positioned in socket region 80 to limit or preclude intrusion of moisture or contaminants from entering the interior of housing 10 through slots 80*c*, Upstanding wall 82 includes a resilient upstanding tab portion 82*a* defining an opening 86 for receiving a ramped projection 88 along an outer surface of clamshell housing 78. Thus, clamshell housing 78 forms a male plug connector with male blade terminals 76*a-c*, which latches into housing base 16 via engagement with upstanding wall 82, so that blade terminals 76 extend downwardly through socket region 80 and project below bottom wall 84 of the housing base 16, such as shown in FIGS. 2 and 8B.

Housing enclosure portion 14 includes a generally planar top wall 90 having arcuate opposite end portions that transition downwardly to upright arcuate walls 92, which terminate at a generally circular bottom rim 94 (FIGS. 1 and 2). An opening is defined between respective inner edge surfaces 90*a*, 92*a*, 94*a* of the respective top wall 90, upright arcuate walls 92, and bottom rim 94 (FIG. 1). Thus, the generally L-shaped outer surface of each outlet housing portion 12 fits into and fills the respective openings defined at opposite sides of the housing enclosure portion 14, with inner edge surface 90*a* corresponding to horizontal top edge 28, upright arcuate walls 92*a* corresponding to upright edges 26, and inner edge surface 94*a* of bottom rim 94 corresponding to arcuate perimeter edges 24. It will be appreciated that the outer surfaces of housing enclosure portion 14 and the outer surfaces of the base leg 12*a* and upright leg 12*b* of each outlet housing portion 12 cooperate to form a substantially closed and exposed outer surface of the electrical power outlet housing 10, such as shown in FIG. 1.

Referring to FIGS. 2 and 4, housing base 16 includes four substantially vertical recesses or channels 96 at its respective four corners, the recesses providing access to openings 38 formed in upper horizontal walls 40, to facilitate the installation of threaded fasteners, such as self-tapping screws, through openings 38 and through corresponding openings formed in the fastener receiving tabs 36 of outlet housing portions 12. The fasteners therefore secure the outlet housing portions 12 directly to housing base 16, and also secure housing enclosure portion 14 to outlet housing portion 12 and housing base 16. This is because the outlet housing portions 12 cannot pass through the openings formed in housing enclosure portion 14 when the outlet housing portions 12 are properly seated therein, such as shown in FIGS. 1 and 2. It is also envisioned that all separate mechanical fasteners could be omitted by substituting integral latching features along interior surfaces of the various housing portions, without departing from the spirit and scope of the present invention.

In the illustrated embodiment, a lower surface of the housing base's bottom wall 84 includes four downwardly-projecting features 98 (FIGS. 2 and 4), which are provided for properly aligning and securing electrical power outlet housing 10 to a raceway junction or the like, such as described in commonly-owned U.S. provisional patent application Ser. No. 62/143,930, filed Apr. 7, 2015, entitled LOW PROFILE ELECTRICAL TERMINAL ASSEMBLY, which is hereby incorporated herein by reference in its entirety, and from which U.S. patent application Ser. No. 15/091,688 (corresponding to U.S. Publication No. 2016/0201169) claims priority. Likewise, male blade terminals 76*a-c* of clamshell housing connector 78 are aligned for engagement with corresponding receptacles of an electrical raceway junction or the like. An optional opening 100 is centrally located in bottom wall 84, and is directly below a corresponding central opening 102 formed in top wall 90 of housing enclosure portion 14. Central openings 100, 102 permit the insertion of a long threaded fastener downwardly through electrical power outlet housing 10, and projecting downwardly out through central opening 100 to engage a threaded bore or threaded fastener associated with an electrical raceway junction to which outlet housing 10 may be mounted.

Accordingly, the electrical power outlet housing of the present invention can be assembled and dissembled with minimal use of fasteners, and with the electrical components of the electrical receptacles being assembled directly to outlet housing portions without need for any separate fasteners. It will be appreciated that the outlet housing portions may be configured to support many different types of electrical and/or electronic data outlets, and without changing the configurations of the other housing components including housing enclosure portion 14 and housing base 16.

Electrical power outlet housing 10 may be configured for attachment to raceway junctions of a modular electrical power system and only one or two steps, including placing the housing on the junction and, optionally, securing the housing in place using a single fastener, if desired. Because the electrical power outlet power housing 10 is generally circular in shape, when viewed from above, the orientations of the electrical outlet or outlet openings 18 can be changed as desired, simply by rotating the electrical power outlet housing and reinstalling at the raceway junction, particularly since the downwardly-projecting features 98 of the bottom wall 84 are arranged symmetrically, allowing the outlet housing 10 to be rotated about a vertical axis extending through central openings 100, 102. Thus, the electrical power outlet housing provides a convenient and readily reconfigurable power and/or data unit that is quickly installed or removed, and is reconfigurable with minimal use of separate fasteners due to the various interlocking features and components used to secure the housing portions together and to secure the electrical components inside the housing.

Changes and modifications in the specifically-described embodiments may be carried out without departing from the principles of the present invention, which is intended to be limited only by the scope of the appended claims as interpreted according to the principles of patent law including the doctrine of equivalents.

The embodiments of the invention in which an exclusive property or privilege is claimed are defined as follows:

1. A housing assembly for mounting electrical and/or data outlets in a work area, said housing assembly comprising:

an outlet housing portion having an exterior surface and an interior surface, said outlet housing portion defining at least one receptacle opening configured to receive a connector;

a housing enclosure portion configured to engage said outlet housing portion and cooperating therewith to define an interior cavity for receiving at least one electrical contact or data outlet, said housing enclosure portion defining an opening in which said outlet housing portion is mounted;

said outlet housing portion comprising attachment structure along said interior surface adjacent said at least one receptacle opening, and projecting into said interior cavity, wherein said attachment structure is configured to support the at least one electrical contact or data outlet; and a housing base coupled to at least one of said outlet housing portion and said housing enclosure portion;

wherein a lower region of said outlet housing portion, a lower region of said housing enclosure portion, and a lower region of said housing base cooperate to form a lower region of said housing assembly; and wherein said lower region of said housing enclosure portion forms an outboard portion of said lower region of said housing assembly, said lower region of said housing base forms an inboard portion of said lower region of said housing assembly, and said lower region of said outlet housing portion is positioned between said lower regions of said housing enclosure and said housing base to thereby form an intermediate portion of said lower region of said housing assembly.

2. The housing assembly of claim 1, wherein said housing base comprises a generally U-shaped frame piece having a base wall located at a lower region of said housing assembly, and a pair of upstanding walls extending into said interior cavity, wherein said outlet housing portions are mounted along and between respective opposite sides of said U-shaped frame piece between said upstanding walls.

3. The housing assembly of claim 1, further comprising an electrical terminal mount configured for releasable engagement with said attachment structure of said outlet housing portion, and wherein said electrical terminal mount cooperates with said attachment structure to secure the at least one electrical contact or data outlet at said interior surface of said outlet housing portion.

4. The housing assembly of claim 3, wherein said electrical terminal mount comprises at least two latch tabs and said attachment structure comprises at least two catches corresponding to said at least two latch tabs.

5. The housing assembly of claim 4, wherein said electrical terminal mount comprises at least two hooks along an opposite side of said electrical terminal mount from said latch tabs, and said attachment structure comprises at least two openings configured to receive respective ones of said at least two hooks.

6. The housing assembly of claim 4, further comprising at least one electrical bus bar contact, wherein said electrical terminal mount and said attachment structure each comprise respective slots or notches that are configured to receive respective portions of said at least one electrical bus bar contact.

7. The housing assembly of claim 1, further comprising at least one electrical contact or data outlet.

8. The housing assembly of claim 7, wherein said at least one electrical contact or data outlet comprises at least one chosen from (i) a 110-volt AC power outlet, (ii) a 220-volt AC power outlet, (iii) a low voltage DC power outlet.

9. The housing assembly of claim 1, wherein said housing base is configured for attachment to a mounting surface.

10. A housing assembly for mounting electrical and/or data outlets in a work area, said housing assembly comprising:

a housing enclosure portion defining an interior cavity, said housing enclosure portion comprising an upper enclosure surface, at least one upright sidewall extending downwardly from said upper enclosure surface, and a lower enclosure portion defining a lower opening that is open to said interior cavity, wherein said upper enclosure surface, said upright sidewall, and said lower enclosure portion cooperate to define a side opening above said lower opening;

an outlet housing portion configured for mounting in said side opening of said housing enclosure portion, said outlet housing portion having an exterior surface and an interior surface, and defining at least one receptacle opening, said outlet housing portion comprising attachment structure along said interior surface adjacent said at least one receptacle opening and projecting into said interior cavity, wherein said attachment structure is configured to support at least two electrical contacts or at least one data outlet;

an electrical terminal mount configured for releasable engagement with said attachment structure, wherein said electrical terminal mount cooperates with said attachment structure to secure the at least two electrical contacts or the at least one data outlet; and a housing base disposed in said lower opening of said housing enclosure portion and coupled to said housing enclosure portion.

11. The housing assembly of claim 10, wherein said housing base is configured for attachment to a mounting surface.

12. The housing assembly of claim 11, wherein said housing base comprises a generally U-shaped frame piece having a base wall disposed in said lower opening of said housing enclosure portion, and a pair of upstanding walls extending into said interior cavity, wherein said outlet housing portion is mounted along and between said upstanding walls of said housing base and said upright sidewalls of said housing enclosure portion.

13. The housing assembly of claim 12, wherein said base wall of said housing base comprises a support structure configured for releasably engaging another electrical or data connector that is accessible through said base wall.

14. The housing assembly of claim 10, wherein said electrical terminal mount comprises at least two latch tabs and said attachment structure comprises at least two catches corresponding to said at least two latch tabs.

15. The housing assembly of claim 14, wherein said electrical terminal mount comprises at least two hooks along an opposite side of said electrical terminal mount from said latch tabs, and said attachment structure comprises at least two openings configured to receive respective ones of said at least two hooks.

16. The housing assembly of claim 10, further comprising at least two electrical bus bar contacts, wherein said electrical terminal mount and said attachment structure each comprise respective slots or notches that are configured to receive respective portions of said at least two electrical bus bar contacts.

17. A housing assembly for mounting electrical and/or data outlets in a work area, said housing assembly comprising:

a housing enclosure portion defining an interior cavity, said housing enclosure portion comprising an upper enclosure surface, at least two upright sidewalls extending downwardly from said upper enclosure surface, and a lower enclosure portion defining a lower opening that is open to said interior cavity, wherein said upper enclosure surface, said upright sidewalls, and said lower enclosure portion cooperate to define a side opening located above said lower opening;

an outlet housing portion configured for mounting in said side opening of said housing enclosure portion said outlet housing portion having an exterior surface and an interior surface, and defining at least one receptacle opening, said outlet housing portion further comprising attachment structure along said interior surface adjacent said at least one receptacle opening and projecting into said interior cavity, wherein said attachment structure is configured to support at least two electrical contacts or at least one data outlet;

an electrical terminal mount configured for releasable engagement with said attachment structure, wherein said electrical terminal mount cooperates with said attachment structure to releasably secure the at least two electrical contacts or the at least one data outlet; and a housing base disposed in said lower opening of said housing enclosure portion and coupled to said housing enclosure portion;

wherein said outlet housing portion is secured in said side opening of said housing enclosure portion via securement of said housing base to said housing enclosure portion.

18. The housing assembly of claim 17, wherein said electrical terminal mount and said attachment structure comprise corresponding latching features, whereby said electrical terminal mount and said attachment structure are configured for releasable engagement without any separate fasteners.

19. The housing assembly of claim 18, wherein said latching features of said electrical terminal mount comprise at least two spaced-apart latch tabs along a first side of said electrical terminal mount and at least two spaced-apart hooks along a second side of said electrical terminal mount opposite said first side, and said latching features of said attachment structure comprise respective pairs of openings formed along opposite sides of said at least one receptacle opening, wherein each of said openings is configured to receive a respective one of said latch tabs or a respective one of said hooks.

20. The housing assembly of claim 17, wherein said housing base comprises a generally U-shaped frame piece having a base wall disposed in said lower opening of said housing enclosure portion, and a pair of upstanding walls extending into said interior cavity, wherein said outlet housing portion is mounted along and between said upstanding walls of said housing base and said upright sidewalls of said housing enclosure portion.

* * * * *